United States Patent [19]

Hillis

[11] Patent Number: 4,545,877

[45] Date of Patent: Oct. 8, 1985

[54] METHOD AND APPARATUS FOR ETCHING COPPER

[76] Inventor: Maurice R. Hillis, 9 Newton La., Chester, Cheshire, England

[21] Appl. No.: 572,084

[22] Filed: Jan. 19, 1984

[30] Foreign Application Priority Data

Jan. 20, 1983 [GB] United Kingdom ..... 8301507

[51] Int. Cl.[4] ..... C25F 5/00; C25C 1/12; C25C 7/00; C25D 21/18

[52] U.S. Cl. ..... 204/130; 204/106; 204/229; 204/237; 204/263

[58] Field of Search ..... 204/130, 140, 106, 252, 204/263-266, 237-229

[56] References Cited

U.S. PATENT DOCUMENTS 4,073,708 2/1978 Hicks, Jr. ..... 204/252 X
4,269,678 5/1981 Faul et al. ..... 204/129.75 X
4,385,969 5/1983 Kastening et al. ..... 204/106
4,468,305 8/1984 Hillis ..... 204/130

*Primary Examiner*—Donald R. Valentine
*Attorney, Agent, or Firm*—Beveridge, DeGrandi & Weilacher

[57] ABSTRACT

A method for etching copper metal from articles, such as printed circuit boards, by contacting the articles with an etchant solution containing cupric tetrammine ions at an etching station, transferring the etchant solution to a catholyte compartment only of an electrochemical cell in which dissolved copper is removed from the solution as copper metal by electrochemical reduction, and returning the etchant solution to the etching station. The invention also provides apparatus specifically adapted for carrying out the method, in which apparatus the electrochemical cell is adapted for the removal of copper from the etchant solution by electrochemical reduction, the cell including an ion exchange membrane to divide the cell into anode and cathode compartments.

20 Claims, 3 Drawing Figures

METHOD AND APPARATUS FOR ETCHING COPPER

FIELD OF THE INVENTION

This invention relates to a method and apparatus for etching copper and in particular to the regeneration of an etchant solution containing cupric tetrammine ions after the etching process.

BACKGROUND OF THE INVENTION

The etching of metals is carried out in a large number of industrial processes, both for the cleaning of metal surfaces, and in order to provide a desired pattern on a metal surface. An example of the application of the latter technique is in the production of so-called "printed circuits" in which a layer of copper on an insulating substrate is etched away in predetermined areas, in order to provide a desired pattern of conducting links on the surface of the insulating substrate.

PRIOR ART

Etchants commonly used in the production of printed circuits include ferric chloride, cupric chloride and various ammoniacal etchants. The latter are particularly used in production of through hole plated boards utilising a metallic resist such as tin-lead. In such situations it is obviously essential for the etchant to be selective in that it must attack the copper but not attack (or only attack very slowly) the metallic resist. Ferric chloride and cupric chloride do not have this selective quality and in such situations alkaline etchants based on ammonia and ammonium salts have to be used.

In U.S. Pat. No. 3,783,113 an elcctrochemical etchant regeneration process is described in which the etchant solution is in contact with both the anode and the cathode of the cell. By putting the etchant in contact with the anode the U.S. inventors have created a problem for themselves. A primary object of the U.S. invention (and of the present invention) is to plate copper out of the etchant. However, by contacting the etchant both with the anode and the cathode this is made very difficult. In order to achieve plating under these conditions the U.S. patent requires the use of a cooled cathode to reduce the etching activity of the etchant in the vicinity of the cathode and the use of conditions as static as possible so as not to mix the electrolyte. A further requirement is to try and reduce the oxygen concentration in the vicinity of the cathode. As oxygen is being continuously evolved at the anode, this is obviously very difficult to achieve.

These difficulties can be overcome by contacting the etchant only with the cathode. A membrane is placed between the anode and cathode and etchant fed into the cathode compartment. The oxygen evolved at the anode cannot reach the cathode compartment and cooled cathodes are not required. Furthermore, the catholyte can be circulated at a rapid rate and need not remain static. Thus much better mass transport to the cathode is achievcd and higher cathode efficiencies result.

In the method described in GB-B-2050428 the etchant solution is fed to both anode and cathode compartments of the cell. Although the disclosed process could also be used for ammoniacal etchants, it has now been found that the process of this invention is better suited for such etchants. This is for two main reasons: (i) as it is inevitable that some re-oxidation of the cuprous ammonium complex to cupric ammonium complex will have taken place in the etching machine before the etching solution reaches the electrolytic cell, the balance between anode and cathode reactions, that is easy to achieve in the case of cupric chloride etchant (where virtually no such air oxidation takes place) is much more difficult to achieve in the case of ammoniacal etchants, and (ii) the divorcing of the copper removal and oxidation stages as in the present invention means that the size of the electrolytic cell may be reduced by operating it 24 hours per day, whereas the etching machine need only be operated, for example, 8 to 12 hours per day.

SUMMARY OF THE INVENTION

The present invention provides a method for etching copper from articles which comprises contacting the articles with an etchant solution containing cupric tetrammine ions to remove copper from the articles at an etching station whereby the concentration by copper in the etchant solution increases, transferring the etchant solution to the cathode compartment only of an electrochemical cell divided into anode and cathode compartments by an ion exchange membrane and removing the copper therefrom as metal by electro-chemical reduction, and returning the etchant solution to the etching station.

Preferably, the electrochemical cell is arranged so as substantially to inhibit aerial oxidation of the copper metal or the electrochemically reduced etchant solution therein.

Preferably, the depth of the etchant solution in the electrochemical cell is large relative to the surface area of the etchant solution which can be exposed to air.

The present invention further provides apparatus for etching copper from articles comprising an etching station at which in use the articles are to be contacted with an etchant solution containing cupric tetrammine ions to remove copper from the articles whereby the concentration of copper in the etched solution will increase, an electrochemical cell adapted for the removal of copper from the etchant solution by electrochemical reduction, the cell including an ion exchange membrane dividing the cell into anode and cathode compartments, means for transferring the etchant solution to the cathode compartment only of the electrochemical cell from the etching station and means for returning the etchant solution from the cathode compartment of the electro-chemical cell to the etching station.

Preferably, the depth of a portion of the electrochemical cell for containing the etchant solution is large relative to the surface area of an open top thereof.

DETAILED DESCRIPTION OF THE INVENTION

Figure 1:
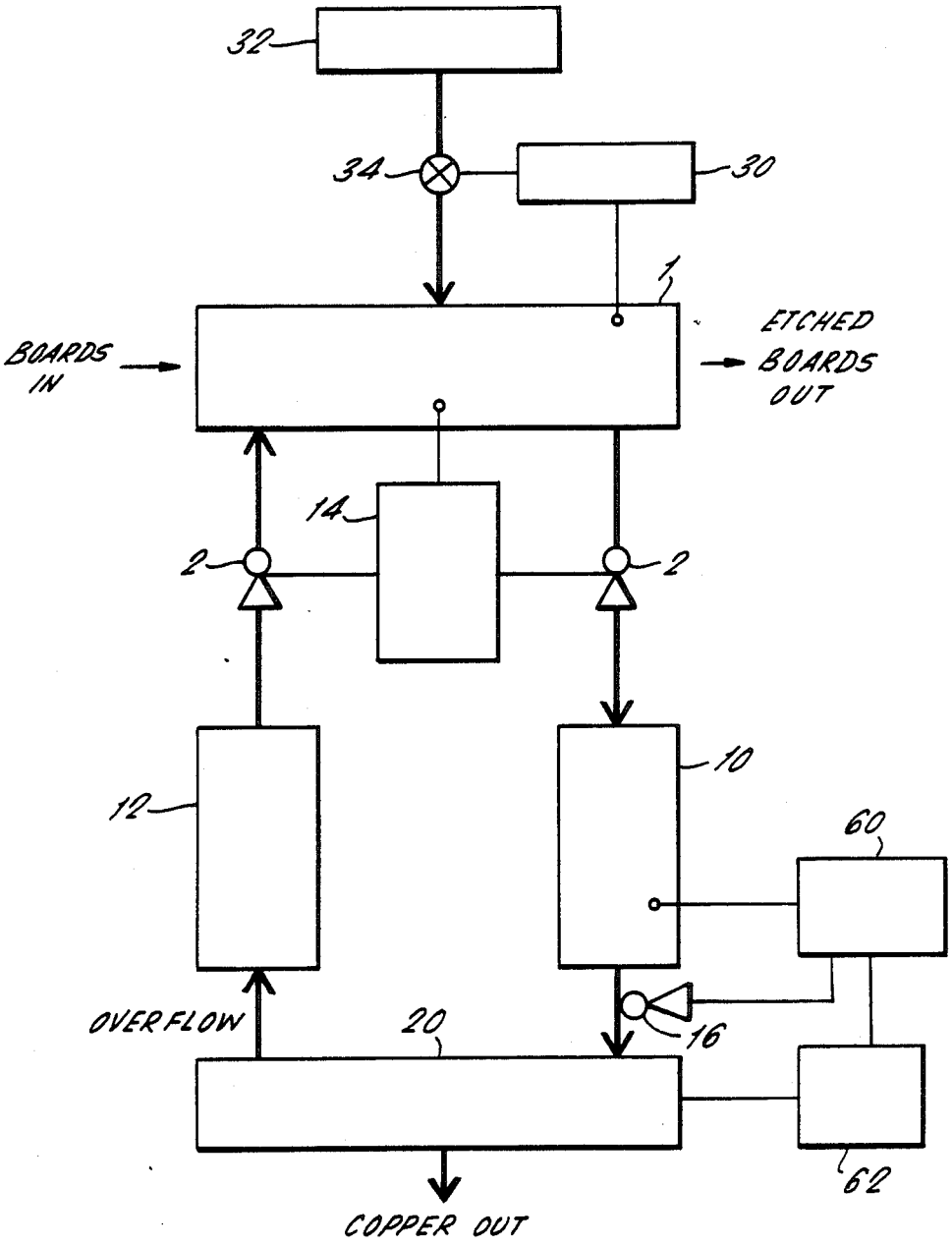
Figure 2:
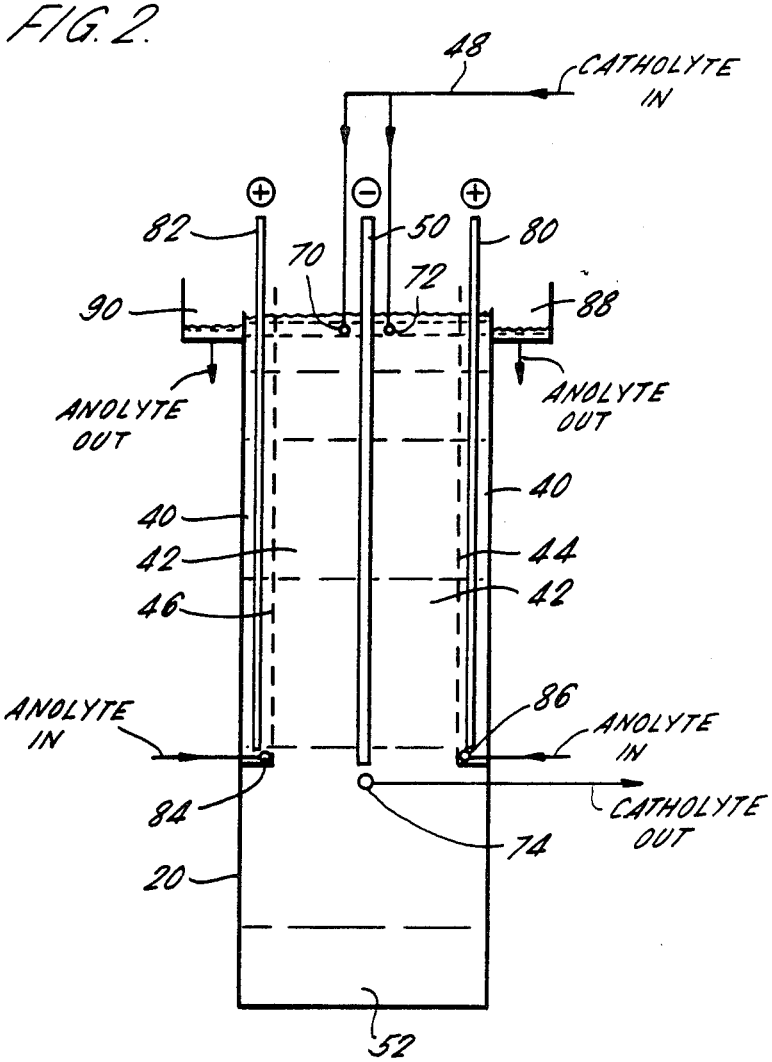
Figure 3:
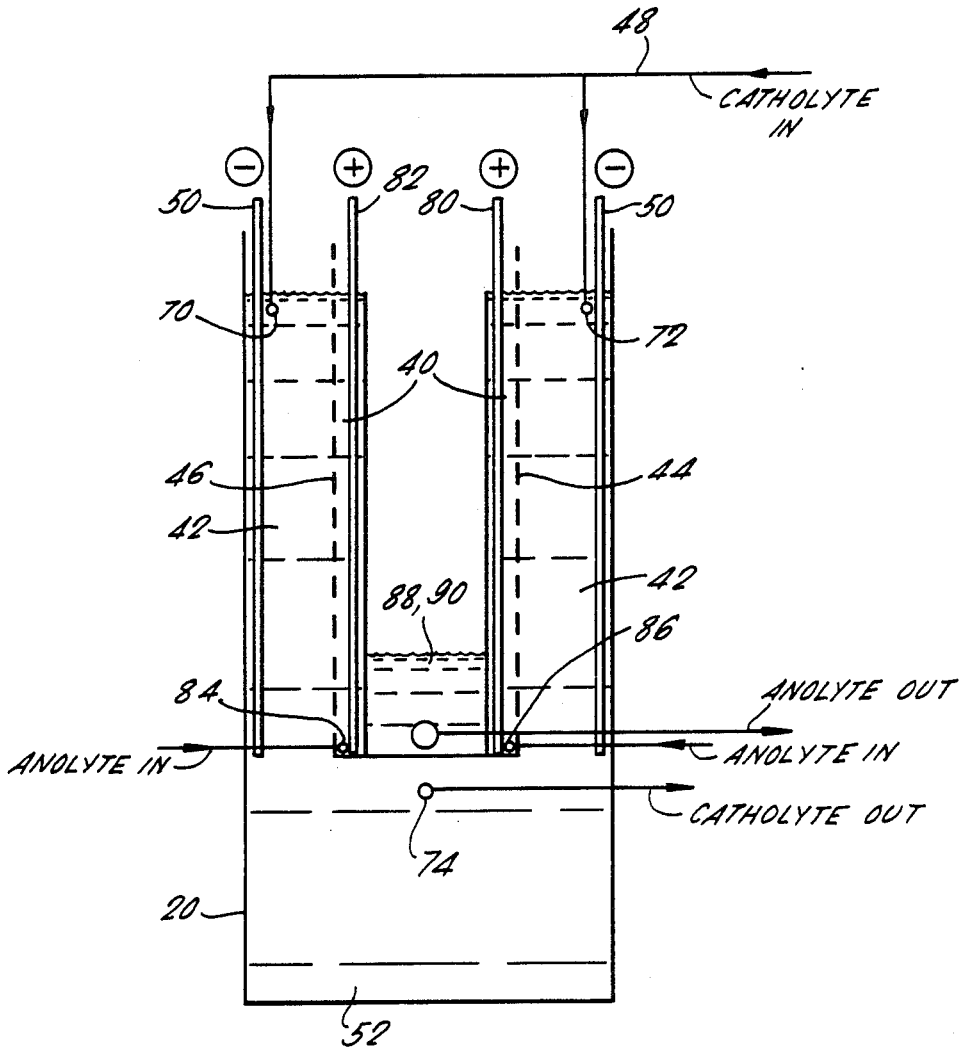

An embodiment of the present invention will now be described by way of example with reference to the accompanying drawings, in which:

FIG. 1 shows schematically a block diagram of an arrangement of electro-chemical processing apparatus; and FIGS. 2 and 3 show schematically two types of electrolytic cell for use in the apparatus of FIG. 1.

As is shown in FIG. 1, an etching machine 1, to contain an etchant and through which printed circuit boards are to be passed is provided with an inlet and an outlet for etchant connected to a double-headed pump 2.

The outlet of the etching machine is connected via one side of the double-headed pump 2 to a storage tank 10 for etchant of relatively high copper content. The storage tank 10 is in turn connected via a metering pump 16 to an inlet of an electrolytic cell 20, further illustrated in FIG. 2.

The metering pump 16 is operatively connected to a low-level controller 60 which is adapted to receive signals from a low level sensing switch (not shown) in the storage tank 10 and to switch off both the metering pump 10 and, through the transformer rectifier 62, the cell current if the level of liquid in tank falls below a pre-set level.

The cell 20 which will be further described hereafter is a divided cell having a cathode compartment through which flows the etchant being treated. The outlet for etchant of the cathode compartment is connected to a storage tank 12 for treated etchant which has a relatively low copper concentration. An outlet from the storage tank 12 is connected via the second side of the double-headed pump 2 to an inlet of the etching machine for etchant.

Means (not shown) are provided to sense when the specific gravity of etchant in the etching machine exceeds a predetermined level. A specific gravity controller 14 is then actuated to switch on double-headed pump 2 to pump etchant at an equal rate from storage tank 12 to the etching machine and from the etching machine to the storage tank 10 until the specific gravity of the etchant in the etching machine falls below a predetermined value.

The apparatus further comprises a pH controller 30 adapted to control a valve 34 which when open releases ammonia from tank 32 progressively into the etching machine.

It is a feature of the etching process that the etchant solution, in attacking the copper and dissolving it, becomes chemically reduced itself. Consequently, to regenerate the etchant solution two objectives have to be achieved: the etchant solution has to be oxidised back to its active oxidised state and the copper dissolved into the etchant solution has to be removed from the etchant solution Ammoniacal etchant solution, as used in a preferred embodiment of the present invention depends for activity on the presence of the cupric tetrammine ion, $Cu(NH_3)_4^{++}$. In dissolving copper this ion becomes reduced to the cuprous diammine ion $Cu(NH_3)_2^{+}$, thus:

$$Cu + Cu(NH_3)_4^{++} \rightarrow 2Cu(NH_3)_2^{+}$$

Preferably, the anion present is the chloride ion and in that case the reaction is:

$$Cu + Cu(NH_3)_4Cl_2 \rightarrow 2Cu(NH_3)_2Cl$$

In the electrochemical cell, the cuprous diammine ion can be reduced to deposit copper metal and release ammonia to be dissolved in the etchant solution.

It is a property of the cuprous diammine ion that it is capable of aerial oxidation to the cupric tetrammine ion in the presence of ammonia and ammonium salts. The reaction can be written as:

$$2Cu(NH_3)_2Cl + \tfrac{1}{2}O_2 + 2NH_4Cl + 2NH_4OH \rightarrow 2Cu(NH_3)_4Cl_2 + 3H_2O$$

This ability of the cuprous diammine ion to be reoxidised to the active form by oxygen present in air can be utilised in the etching process. The re-oxidation occurs subsequent to the electrochemical reduction of etchant solution in the electrochemical cell, which results in removal of copper from the etchant solution.

In the apparatus described above reduced etchant is produced by the electrochemical cell and also by the etching reaction. The etchant solution is contacted with the work to be etched by spraying. This provides sufficient contact with air to reoxidise the etchant.

The etching of copper from articles such as printed circuits boards in the etching machine causes the copper concentration of the etchant in the machine, and hence the specific gravity, to rise. When the specific gravity controller is triggered, it activates the double-headed pump 2 which then pumps out a predetermined volume of the etchant from the machine 1 into the exhausted (i.e. high copper) etchant storage tank 10. At the same time a corresponding volume of regenerated (i.e. low copper) etchant is pumped into the etching machine from the low copper etchant storage tank 12.

From tank 10 etchant high in copper is continuously pumped by metering pump 16 into the cathode compartment of cell 20 where copper is plated out at one or more cathodes thereof. Overflow from the cathode compartment of eletrolytic cell 20, which is of a much lower copper concentration than the etchant entering the electrolytic cell 20, flows into tank 12. Here the ammonium chloride level is adjusted to compensate for drag out and other losses and the etchant is then suitable for return to the etching machine 1. If desired this regenerated etchant may first be used for washing the boards leaving the etching machine 1 in order to reduce carry over of copper solution into the rinse water.

The pH controller 30 measures the pH of the etchant in the etching machine and causes ammonia to be added as required in order to compensate for evaporative losses and drag out losses on the boards as they are removed from the etching machine 1 and thus maintain the pH within predetermined limits which are usually between 8 and 9. Ammonia is added from the ammonia tank 32 which may be either a gas cylinder or a reservoir of concentrated ammonia solution.

As may be seen in FIG. 2, the electrolytic cell 20 is divided into anode and cathode compartments 40, 42 by ion exchange membranes 44,46. The high copper concentration etchant from tank 10—the catholyte 48—is pumpted via metering pump 16 into the cathode compartment 42 of the electrolytic cell 20.

The arrangement of the cell shown in FIG. 2 is for a three electrode (one cathode 50 two anodes 80,82) electrolytic cell. It will be appreciated that the cell size can be increased by having a greater number of electrodes as required. The cathode 50 is placed in the centre of the cell 20 and is preferably made of for example graphite, titanium or any other suitable material. A catholyte pump (not shown) circulates the catholyte via a cooling system (not shown) to two distribution pipes 70,72 located on either side of the cathode 50 and each extending across the whole width of the cell 20 just below the level of the catholyte in the cell 20. Each pipe is drilled with holes (not shown) and these direct the flow of catholyte down each face of the cathode 50. Catholyte is withdrawn from the cell 20 by a take-off tube 74 located just below the cathode 50. This extends across the whole width of the cell 20 and is drilled with a series of holes (not shown). From this tube 74 the catholyte returns to the catholyte circulation pump.

It is also possible, of course, by notionally splitting the single cathode in two, to reverse the above geometry and to place two cathodes towards the outer walls of cell and to place the two anodes towards the centre of the cell. The anolyte then flow up the anodes and over respective weirs into a centrally placed common overflow compartment as shown in FIG. 3. The same reference numerals are used in FIG. 3 as are used in FIG. 2.

The depth of the cell 20 is large compared to the width so that the exposed surface of the catholyte is minimised, thereby to reduce aerial oxidation of the catholyte in the cell 20. The cathode reaction occuring in the cell 20 is the electroreduction of the incoming catholyte, and it is undesirable to allow aerial oxidation to act simultaneously in opposition to the electroreduction. Other methods of substantially eliminating aerial oxidation of the catholyte may be employed such as, for example, the provision of an inert gas blanket over the surface of the catholyte in the cell 20.

An anolyte circulation pump (not shown) pumps an anolyte through a cooling coil (not shown) and then via pipework into the bottom of each anode compartment 40 via feed pipes 84, 86 extending across the full width of the compartment. Each pipe is likewise drilled with a series of holes (not shown) for distribution of the anolyte. The anolyte flows up the face of each anode 80, 82 and leaves at the top of each anode compartment via a respective wier 88, 90. Each anode 80, 82 is drilled with a series of holes (not shown) at wier height to permit the anolyte free passage to the respective wier 88, 90. From the wiers 88, 90 the anolyte returns to the anolyte circulation pump (not shown).

The anodes 80, 82 are merely counter electrodes and the reaction taking place at them is oxygen evolution. The anolyte can be sulphuric acid, caustic soda or any other suitable solution.

The catholyte is substantially a solution containing cuprous diammine ions. The etchant that is pumped into the cathode compartment 42 of the cell 20 of course contains cupric tetrammine ions but these are rapidly reduced at the cathode 50 to cuprous diammine ions and then become further reduced to copper metal.

The concentration of copper in the catholyte is maintained within a range of from about 5 g/l to 15 g/l. Within this range the copper is deposited without hydrogen evolution and in a dendritic form that easily detaches itself from the cathode 50. In order to ensure that there is no possibility of copper growing from the cathode 50 as far as the membrane and the possibly damaging the membrane it is prudent to provide a scraper mechanism (not shown) operating between the cathode 50 and the membranes 44, 46.

The copper that forms as loose dendrites on the cathode 50 falls to the bottom 52 of the cell 20 where it may be allowed to accumulate. If sufficient storage space is built into the bottom 52 of the cell 20, the copper may accumulate for several weeks before the cell 20 need be drained down and the copper removed. Alternatively, the copper dendrites may be swept away from the bottom 52 of the cell 20 into a copper recovery system (not shown) from which the copper can be removed at frequent intervals, conveniently once a shift, and in this case copper storage capacity at the bottom 52 of the cell 20 need not be provided. Furthermore, in this case the cell 20 need not be drained down for copper removal.

The catholyte is circulated over the face of the cathode 50 by means of a catholyte circulation pump (not shown). Circulation of the electrolyte rapidly mixes and transports the incoming cupric tetrammine ions to the cathode where they become reduced as described hereinabove. Furthermore, it prevents concentration polarisation at the cathode 50 that could lead to hydrogen production, and it also allows the catholyte to be passed through a cooling system (not shown) to maintain its temperature at about 50° C. In a similar manner the anolyte which is a solution of sulphuric acid, caustic soda or any other suitable electrolyte is circulated by an anolyte circulation pump (not shown) and passed through a cooling system (not shown) to maintain it also at about 50° C. The anode reaction is mainly the evolution of oxygen.

It is an advantage of this regeneration system that the electrolytic cell 20 may be operated 24 hours per day even though the etching machine 1 is only operating, say, 8 hours per day. This means that the electrolytic cell 20 can be much smaller (for example three times smaller) than if the electrolytic cell 20 had to be sized to link directly, and so as to work concurrently, with the etching machine 1. It is also possible to operate the electrolytic cell 20 under very steady conditions if the average amount of copper being etched in a period, for example, a week, is known, as will usually be the case in practice. It then follows, as the etchant is being pumped into storage tank 10 at a fixed copper concentration (determined by the setting of the specific gravity controller 14 on the etching machine 1), that it will be possible to determine the rate at which this solution should be metered from storage tank 10 into the cell 20 so as to achieve the desired removal of copper, averaged over a period of time, and as the rate of removal of copper at the cathode 50 (in g/amp hour) can be determined by experiment then the current which should be applied to the cell 20 is also known and the cell 20 can be appropriately regulated.

If, for some reason (such as a break in production), the amount of copper being etched should fall below that expected then storage tank 10 would eventually become depleted below a particular value. Low level controller 60 on this tank would then be activated to switch off the current to the electrolytic cell 20 and stop the metering pump 16 from supplying etchant to the cell 20. When work resumes and etchant is transferred into storage tank 10, so as to raise the level in the tank above the said particular value, the metering pump 16 and electroyltic cell 20 are automatically restarted by low level controller 60.

The ammoniacal etchants used in the printed circuit board (PCB) industry are mainly proprietary and as well as containing ammonia and ammonium salts they also contain various additives. These additives are claimed by the manufacturers of these proprietary etchants to produce certain benefits such as enabling the etchant to contain increased quantities of copper, to etch faster, to decrease the amount of undercut and to decrease the attack by the etchant on the metallic resist on the printed circuit board.

In a system such as the present one in which the copper is being continuously removed from the etchant there is no need for the etchant to have a large capacity for copper. This is only of interest where the etchant is being used and then removed from the system as a whole. In fact the present system can operate with etchant concentrations of about 80 g of copper per liter as opposed to levels of about 150 g/l which are currently used in the PCB industry. This is an advantage as sludging of the etchant does not take place so easily, as a result of the etchant temperature dropping, due to the lower concentrations of copper in solution in practice.

It is, however, quite possible to operate the present process at a copper concentration of 150 g/l should this be desired.

A simple formulation based on ammonia and ammonium chloride or ammonium sulphate is satisfactory as to the rate of etching, undercut factor and attack on the tin lead on the boards. However the present process may be used with proprietary etchants if desired. It would be necessary, however, for the regenerated etchant in tank 12 to be analysed for the additives and for appropriate additions to be made to compensate for losses due to drag out, etc. In addition the additives would have to be compatible with the process and not undergo electro-reduction at the cathode 50.

As has been previously explained the efficiency of copper deposition is known (it is approximately 1 g/Ah), and from this knowledge and a knowledge of the concentration of copper in the tank 10, which is determined by the setting of the specific gravity controller in the etching machine 1, it is possible to calculate the rate at which etchant should be metered from the storage tank 10 into the cathode compartment 42 of the cell 20. For example, a 5,000 A, cell recovering copper at 5 kg/h would have etchant metered into the catholyte at a rate of 62.5 l per hour if the etchant was being discharged from the etching machine 1 at a concentration of 80 g of copper per liter.

An example of the arrangement and operation of a preferred electrolytic cell and etching station for use in the method and apparatus of the present invention is described hereinbelow, using a cell of the type shown in FIG. 2.

EXAMPLE A

An electrolytic cell was constructed which contained a platinised titanium anode having a rectangularly shaped active surface of size approximately 7.6 cm×5.0 cm. The anode was separated from a graphite cathode having a similar active surface area by a Nafion cation exchange membrane. The anolyte consisted of 10 liters of 10% sulphuric acid, which was circulated from a reservoir through the anode compartment and back to the anolyte reservoir at a rate of 2 liter/min. The catholyte was 6 liters in volume and was similarly circulated from a catholyte reservoir through the cathode compartment of the cell and back to the catholyte reservoir at a rate of 2 liters/min. A small tank was used for etching the copper and this contained a spray unit to oxidise the etchant aerially. The etchant consisted of a solution of ammonium chloride and ammonium hydroxide and was operated at a pH of 8.5 and a copper concentration of 80 g/l. The etchant temperature was 50° C. Copper metal was added at regular intervals to this etching tank to simulate the operation of an etching machine. From this tank etchant was pumped to the cathode compartment of the electrolytic cell by a peristaltic pump. The overflow from the cathode compartment was returned to the etching tank. The catholyte consisted of the reduced etchant. The operational variables of the electrolytic cell were adjusted so as to maintain the copper concentration in the catholyte between 5 and 10 g/l. A direct current of 15 A was applied to the cell and this required a voltage of 10 V. Copper deposited on the cathode in dentritic form and fell to the bottom of the cathode compartment from where it was removed from time to time. The laboratory cell was operated for a period of 12 months on a 24 hour per day basis during which time the etchant continued to operate satisfactorily and the copper etched in the etching tank was recovered from the cathode at an average current consumption of 0.5 g/Ah. Additions of ammonium hydroxide solution and solid ammonium chloride were made to the etchant to compensate for evaporative and other losses. The cell was operated at 50° C.

A second example illustrating a preferred method and apparatus for etching copper is described hereinbelow.

EXAMPLE B

A pilot plant was constructed containing an electrolytic cell generally as shown in FIG. 2 having a central graphite cathode 50 with an effective electrode area approximately 0.56 m×0.46 m. This was separated from two anodes 80, 82 placed on either side of the cathode 50 by two cation exchange membranes 44, 46. Each anode 80, 82 was made of platinised titanium and was the same size as the cathode 50. Of course in the case of each anode 80, 82 only the face opposite the cathode 50 was electrolytically effective whereas the cathode 50 was effective on both faces. A simple scraper (not shown) was placed between each face of the cathode 50 and the membranes 44, 46. A direct current of 2,000 A was applied to the cell and this required a voltage of 12 V.

The anolyte was a 10% sulphuric acid solution, 68 liters in volume and this was pumped through a cooling coil (not shown) up the face of each anode 80, 82 at a rate of 50 liters/min., and was passed over weirs 88, 90 at the top of the cell. The catholyte was 150 liters in volume and was substantially all contained within the cathode compartment 42 and the copper collection volume 52 immediately below the cathode compartment 42. Catholyte was withdrawn from just below the cathode 50 and pumped via a closed loop containing a cooling coil back to an inlet pipe 70, 72 just below the catholyte surface. The surface of catholyte exposed to atmosphere was very small in relation to the volume of the catholyte. The rate of cathoylte circulation was 150 liters/min. The electrolytic cell 20 was linked to a commercial printed circuit board spray etching machine via a transfer line which was teed off the pressure side of the pump supplying etchant to the spray jets in the etching machine. This transfer line linked the etching machine to the cathode compartment of the electrolytic cell and a control valve in this transfer line allowed etchant to be passed to the electrolytic cell at a rate of about 25 liters per hour. The overflow from the cathode compartment was returned to the etching machine.

The etchant in the etching machine was operated at a temperature of 50° C. and at a pH of 8.5. It consisted of a solution of ammonium chloride and ammonium hydroxide. The volume of etchant in the machine was 127 liters. Copper clad boards were fed into the etching machine at a rate equivalent to 2 kg of copper per hour and copper was deposited on the cathode at the same rate so that the copper concentration in the etchant was held steady at 80 g/l. The catholyte was a reduced etchant solution and the copper concentration in it was 5–10 g/l. The cell was operated 8 hours per day 5 days per week for several months and over this period the efficiency of copper removal was 1.0 g/Ah and the etchant was maintained in a substantially unchanged condition. Additions of ammonium hydroxide solution and solid ammonium chloride were made to the etchant to compensate for evaporative, drag out and other losses.

The copper deposited on the cathode 50 in dendritic form and it fell from the cathode 50 into the copper collection volume 52 at the base of the cell 20. It was allowed to accumulate there until the compartment was full. This was usually 2 to 3 weeks. Then the cell was drained down and the copper removed via a port-hole (not shown) located near the base of the cell 20. The operation of the scrapers located between the cathode 50 and the membranes 44, 46 ensured that no dendrite of copper could grow out far enough to damage the membranes 44, 46.

Should it be found that chlorine is discharged from the cell, then it is probable that the membrane is damaged or not mounted securely, thereby allowing chloride ions to pass to the anode. Such chlorine loss has to be made good by the addition of ammonium chloride, and, if excessive, can be overcome by recovery of the chlorine gas in a scrubber system. Preferably such a scrubber system would use overflowed catholyte solution as the contacting solution and thereby any chlorine which evolves at the anode is dissolved in this solution and converted back to ammonium chloride. In those cases where the electrolytic cell is not directly coupled to the etching machine, the solution contained in the low copper etchant storage tank, 12, could most conveniently be used to scrub the anode gases. Otherwise a special overflow tank would be required to receive catholyte and scrub the anolyte gases and the return to the etching machine would also be drawn from this tank.

What is claimed is:

1. In a method for etching copper from articles which comprises contacting the articles with an etchant solution containing cupric tetrammine ions to remove copper from the articles at an etching station whereby the concentration of copper in the etchant solution increases, transferring the etchant solution to an electrochemical cell, removing the copper from the etchant solution as metal by electrochemical reduction in the cell, and returning the etchant solution to the etching station, the improvement which comprises transferring the etchant solution to the cathode compartment only of the electrochemical cell, the cell being divided into anode and cathode compartments by an ion exchange membrane.

2. A method as claimed in claim 1 wherein the electrochemical cell is arranged so as substantially to inhibit aerial oxidation of the copper metal and the electrochemically-reduced etchant solution therein.

3. A method as claimed in claim 2 wherein the depth of the etchant solution in the electrochemical cell is large relative to the surface area of the etchant solution exposed to air.

4. A method as claimed in claim 1, 2 or 3 wherein a cation exchange membrane divides the cell into anode and cathode compartments.

5. A method as claimed in claim 3 wherein the etchant solution is transferred from the etching station to the electrochemical cell when the specific gravity thereof exceeds a threshold value.

6. In a method for etching copper from articles, which comprises contacting the articles with an etchant solution containing cupric tetramine ions to remove copper from the articles at an etching station whereby the concentration of copper in the etchant solution increases, transferring the etchant solution to an electrochemical cell, removing the copper from the etchant solution as metal by electrochemical reduction in the cell, and returning the etchant solution to the etching station, the improvement which comprises transferring the etchant solution to the cathode compartment only of the electrochemical cell, the cell being divided into anode and cathode compartments by an ion exchange membrane;

wherein the electrochemical cell is arranged so as substantially to inhibit aerial oxidation of the copper metal and the electrochemically-reduced etchant solution therein;

the depth of the etchant solution in the electrochemical cell being large relative to the surface area of the etchant solution exposed to air;

wherein the etchant solution is transferred from the etching station to the electrochemical cell when the specific gravity thereof exceeds a threshold value; and wherein the pH of the etchant solution at the etching station is measured and maintained by a pH controller which can activate means to introduce ammonium ions into the etchant solution at the etching station.

7. A method as claimed in claim 6 wherein the ammonium ions are introduced in a form selected from the group consisting of aqueous ammonia and gaseous ammonia.

8. A method as claimed in claim 7 wherein the pH of the etchant solution at the etching station is maintained between the values of 8 and 9.

9. A method as claimed in claim 8 wherein the etchant solution is transferred from the etching station to the electrochemical cell via a first storage tank and the etchant solution is returned from the electrochemical cell to the etching station via a second storage tank.

10. A method as claimed in claim 9 wherein the etchant solution can be passed continuously from the first storage tank to the electrochemical cell and from the electrochemical cell to the second storage tank.

11. A method as claimed in claim 10 wherein the quantity of etchant solution in the first storage tank is monitored by a low level controller which is operable to stop the flow of etchant solution to, and current from being supplied to, the electrochemical cell, when the said quantity falls below a pre-set value.

12. In an apparatus for etching copper from articles comprising an etching station at which in use the articles are to be contacted with an etchant solution containing cupric tetrammine ions to remove copper from the articles whereby the concentration of copper in the etchant solution will increase, an electrochemical cell adapted for the removal of copper from the etchant solution by electrochemical reduction, an ion-exchange membrane dividing the cell into anode and cathode compartments means for transferring the etchant solution to the electrochemical cell from the etching station (1) and means for returning the etchant solution from the electrochemical cell to the etching station, the improvement which comprises arranging for the etchant solution to be transferred to and returned from the cathode compartment only of the cell.

13. Apparatus as claimed in claim 12 wherein the electrochemical cell is arranged so as substantially to inhibit aerial oxidation of the copper metal and the electrochemically-reduced etchant solution therein.

14. Apparatus as claimed in claim 13 wherein the depth of a portion of the electrochemical cell for containing the etchant solution is large relative to the surface area of an open top thereof.

15. Apparatus as claimed in claim 12, 13 or 14 wherein the ion exchange membrane is a cation exchange membrane.

16. Apparatus as claimed in claim 14 further comprising means for measuring the specific gravity of etchant solution at the etching station the said means for measuring being operable to activate the said means for transferring when the specific gravity of the etchant solution at the etching station exceeds a threshold.

17. In an apparatus for etching copper from articles comprising an etching station at which in use the articles are to be contacted with an etchant solution containing cupric tetramine ions to remove copper from the articles whereby the concentration of copper in the etchant solution will increase, an electrochemical cell adapted for the removal of copper from the etchant solution by electrochemical reduction, an ion-exchange membrane dividing the cell into anode and cathode compartments, means for transferring the etchant solution to the electrochemical cell from the etching station, and means for returning the etchant solution from the electrochemical cell to the etching station, the improvement which comprises arranging for the etchant solution to be transferred to and returned from the cathode compartment only of the cell;

wherein the electrochemical cell is arranged so as substantially to inhibit aerial oxidation of the copper metal and the electrochemically-reduced etchant solution therein;

the depth of a portion of the electrochemical cell for containing the etchant solution being large relative to the surface area of an open top thereof;

means for measuring the specific gravity of etchant solution at the etching station, the said means for measuring being operable to activate the said means for transferring when the specific gravity of the etchant solution at the etching station exceeds a threshold; and a pH controller for measuring and maintaining the pH of the etchant solution at the etching station by activating means for introducing ammonium ions into the etchant solution at the etching station.

18. Apparatus as claimed in claim 17 wherein the introducing means introduces ammonia in a form selected from the group consisting of aqueous ammonia and gaseous ammonia.

19. Apparatus as claimed in claim 18 further comprising a first storage tank and a second storage tank via which etchant solution is transferred from the etching station to the electrochemical cell and returned from the electrochemical cell to the etching station respectively.

20. Apparatus as claimed in claim 19 further comprising a low level controller arranged to monitor the quantity of etchant solution in the first storage tank and operable to stop the flow of etchant solution to, and current from being supplied to, the electrochemical cell when the said quantity falls below a pre-set value.

* * * * *